US010226713B2

(12) United States Patent
Huang

(10) Patent No.: US 10,226,713 B2
(45) Date of Patent: Mar. 12, 2019

(54) HUMAN-POWERED ENTERTAINMENT DEVICE

(71) Applicant: BESTWAY INFLATABLES & MATERIAL CORP., Shanghai (CN)

(72) Inventor: Shuiyong Huang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 15/614,265

(22) Filed: Jun. 5, 2017

(65) Prior Publication Data

US 2018/0264371 A1 Sep. 20, 2018

(30) Foreign Application Priority Data

Mar. 15, 2017 (CN) ..... 201720250792.7

(51) Int. Cl.

| | |
|---|---|
| ***A63H 23/10*** | (2006.01) |
| ***A63G 31/12*** | (2006.01) |
| ***A63G 31/00*** | (2006.01) |
| ***B63C 9/08*** | (2006.01) |
| ***B63B 35/76*** | (2006.01) |

(52) U.S. Cl.

CPC ..... *A63H 23/10* (2013.01); *A63G 31/007* (2013.01); *A63G 31/12* (2013.01); *B63B 35/76* (2013.01); *B63C 9/08* (2013.01)

(58) Field of Classification Search

CPC ..... A63H 23/00; A63H 23/04; A63H 23/10; A63B 35/00; B63B 35/00; B63B 35/58; B63B 7/00; B63B 7/08; B63B 7/085; A63G 31/00; A63G 31/007; A63G 31/12

USPC ..... 446/153, 156–157, 160, 163; 472/128, 472/129, 134; 441/76, 77

See application file for complete search history.

(56) References Cited

U.S. PATENT DOCUMENTS

| | | | | |
|---|---|---|---|---|
| 1,851,768 A | | 3/1932 | Hubbell | |
| 2,245,401 A | * | 6/1941 | Hooker | A63B 35/00 440/104 |
| 2,404,729 A | | 7/1946 | Hurt | |
| 2,581,545 A | | 1/1952 | Long | |
| 2,688,207 A | | 9/1954 | Hurt | |
| 2,941,219 A | | 6/1960 | Irving | |
| 4,336,931 A | | 6/1982 | van Staden | |

(Continued)

FOREIGN PATENT DOCUMENTS

| | | |
|---|---|---|
| FR | 2524331 | 10/1983 |
| FR | 2913205 | 9/2008 |
| WO | 2003035186 | 5/2003 |

OTHER PUBLICATIONS

Extended European Search Report dated Dec. 21, 2017 by the European Patent Office for related European patent application 17174790.0.

*Primary Examiner* — Kien Nguyen

(74) *Attorney, Agent, or Firm* — AJ Moss; Dickinson Wright PLLC

(57) ABSTRACT

The present disclosure provides a human-powered entertainment device. The entertainment device includes an inflatable base and a paddling component which is connected with the inflatable base, wherein the paddling component is adapted to swing when a force is imposed thereon, so as to perform paddling in water to make the human-powered entertainment device move on water. Accordingly, the entertainment device of the present disclosure can be driven to move and low in cost.

17 Claims, 9 Drawing Sheets

(56) References Cited

U.S. PATENT DOCUMENTS

| | | | | |
|---|---|---|---|---|
| 4,938,722 | A | 7/1990 | Rizley | |
| 6,837,765 | B2 * | 1/2005 | Lauziere | B63B 35/58 441/130 |
| 6,997,133 | B1 * | 2/2006 | Song | B63B 7/08 114/345 |
| 7,361,071 | B1 * | 4/2008 | Lauren | B63B 35/83 441/76 |
| D759,182 | S | 6/2016 | Wampold | |
| D785,119 | S | 4/2017 | Hempton | |
| D787,617 | S | 5/2017 | Krepack | |
| 2007/0178801 | A1 * | 8/2007 | Matias | A63H 23/10 446/157 |
| 2011/0076910 | A1 * | 3/2011 | Johnston | A63H 23/04 446/163 |
| 2015/0336634 | A1 * | 11/2015 | Swan | B63B 7/085 114/345 |

* cited by examiner

HUMAN-POWERED ENTERTAINMENT DEVICE

CROSS-REFERENCE TO RELATED APPLICATIONS

The present application claims priority to Chinese patent application No. 201720250792.7, filed on Mar. 15, 2017, and entitled "HUMAN-POWERED ENTERTAINMENT DEVICE", and the entire disclosure of which is incorporated herein by reference.

TECHNICAL FIELD

The present disclosure generally relates to the technical field of entertainment device, and more particularly, to a human-powered entertainment device.

BACKGROUND

Inflatable entertainment device is a kind of water recreation facility that can float on water. Some of existing inflatable entertainment devices, such as an inflatable flamingo or an inflatable swan, may include an inflatable base, a head portion, a tail portion and wings portion, but do not include a power device, which makes it hard for the user to move on water. Some of existing inflatable entertainment devices may include a power device, such as an electric propeller, which makes the inflatable device can move on water. However, this kind of entertainment device with the power device is complicated in structure, high in cost and limited in duration.

Therefore, there is a need for a human-powered entertainment device which is low in cost and can move on water.

SUMMARY

An object of the present disclosure is to provide a human-powered entertainment device which is low in cost and can move on water.

In order to achieve above recited object, embodiments of the present disclosure provide a human-powered entertainment device. The entertainment device may include an inflatable base and at least one paddling component connected with the inflatable base. Further, the at least one paddling component is capable of swinging when a force is imposed thereon so as to perform paddling in water to make the human-powered entertainment device move on water.

In some embodiments, the at least one paddling component may be provided with at least one handle.

In some embodiments, a number of the at least one paddling component may be more than one; and each two of the paddling components may be disposed opposite to each other and provided with the at least one handle.

In some embodiments, each of the at least one paddling component may include a paddling portion configured to swing to perform paddling in water; and a connecting portion for connecting the paddling portion with the inflatable base.

In some embodiments, the connecting portion may be configured to be a rotary mechanism.

In some embodiments, the connecting portion may include a male structure part and a female structure part; and the male structure part may be rotatably accommodated in the female structure part.

In some embodiments, the connecting portion may include an elastic part adapted to be bended, such that the paddling portion is capable of swinging.

In some embodiments, the paddling portion may be made of rigid plastic.

In some embodiments, the paddling portion may include a webbed portion; and the webbed portion may be made of flexible plastic and can be unfolded for performing paddling.

In some embodiments, the paddling portion may be detachably connected with the connecting portion.

In some embodiments, the paddling portion may be integrally connected with the connecting portion.

In some embodiments, both the connecting portion and the paddling portion may be inflatable and have a common air chamber.

In some embodiments, at least one of the connecting portion and the paddling portion may be provided with at least one handle.

In some embodiments, the paddling portion may be provided with a flexible webbed portion; and when the flexible webbed portion is configured to be unfolded when the air chamber is inflated with air.

In some embodiments, the paddling portion may be provided with an enhancement portion. The enhancement portion may be attached to a surface of the paddling portion to maintain a shape of the paddling portion when the paddling portion performs paddling.

In some embodiments, the enhancement portion may be detachably connected with the paddling portion.

In some embodiments, when the connecting portion is inflated, a cross section of the connecting portion may be shaped in circle or oval.

In some embodiments, when the connecting portion is inflated, the cross section of the connecting portion may be shaped in circle with a diameter ranging from 5 cm to 25 cm.

In some embodiments, when the connecting portion is inflated, the cross section of the connecting portion may be shaped in oval with a long axis ranging from 5 cm to 25 cm.

In comparison with existing technologies, technical solutions of the present disclosure possess following advantages:

In the human-powered entertainment device provided by embodiments of the present disclosure, a paddling component is configured. When an external force is imposed by a user to the paddling component, the paddling component can swing so as to perform paddling. Accordingly, when the entertainment device is put in use, the user can use the paddling component to push water, which can make the entertainment device move on the water. Therefore, functions and entertaining of the device are enhanced with a low cost and simple structure.

Further, the paddling component may be configured to be an inflatable structure and an enhancement portion may be further disposed on the paddling portion of the padding component. The enhancement portion can maintain a shape of the paddling portion when the paddling portion swings to perform paddling, which increases a rigidity of the paddling component and improves an efficiency of the paddling.

Further, the connecting portion of the paddling component may be configured to be a rotary mechanism (e.g., including a male structure part and a female structure part) which is adapted to be rotated for performing paddling.

Further, the paddling component may be provided with a handle. The handle can be held by the user to impose the force to the padding component, which facilitates the paddling process and improves safety of the entertainment device.

DETAILED DESCRIPTION

As recited in the background, existing inflatable entertainment devices which are not configured with a power device is hard to be driven to move on water; and existing inflatable entertainment devices which are configured with a power device (e.g., an electric propeller) are able to move on the water, but are complicated in structure, high in cost and limited in duration.

Accordingly, an embodiment of the present disclosure provides a human-powered entertainment device, including: an inflatable base and a paddling component connected with the inflatable base. When a force is imposed to the paddling component, the paddling component can swing so as to perform paddling. Accordingly, when the entertainment device is put in use, the user can use the paddling component to paddle water, which will make the entertainment device move on the water. Therefore, functions and entertaining of the device are enhanced and cost is reduced.

In order to make objectives, features and advantages of the present disclosure more clear, embodiments of the present disclosure will be described in detail in conjunction with the accompanying drawings.

Figure 1:
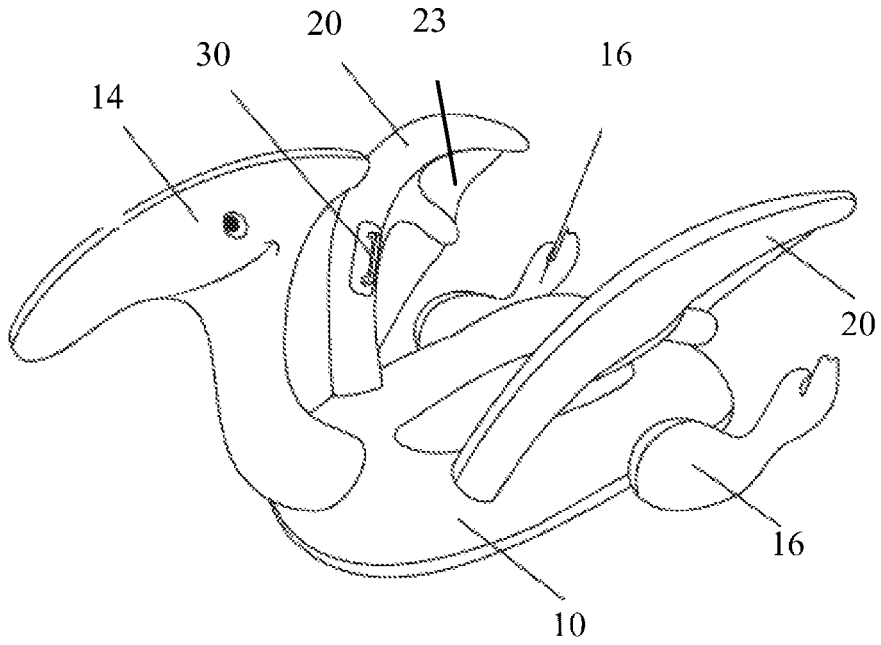
FIG. 1 is a stereogram of a human-powered entertainment device according to one embodiment of the present disclosure.
Figure 2:
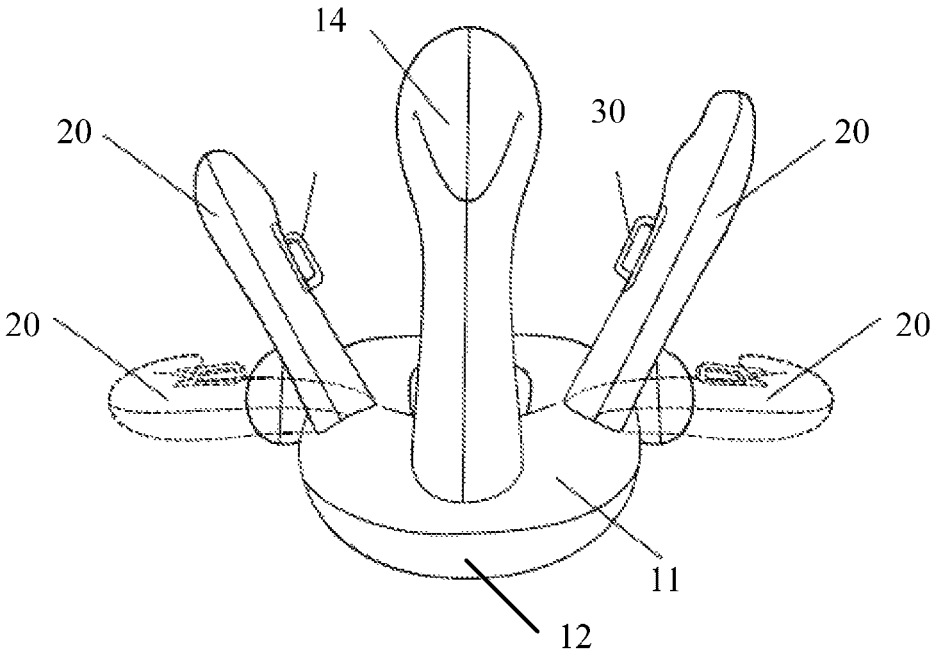
FIG. 2 is an end view of a human-powered entertainment device according to one embodiment of the present disclosure.
Figure 3:
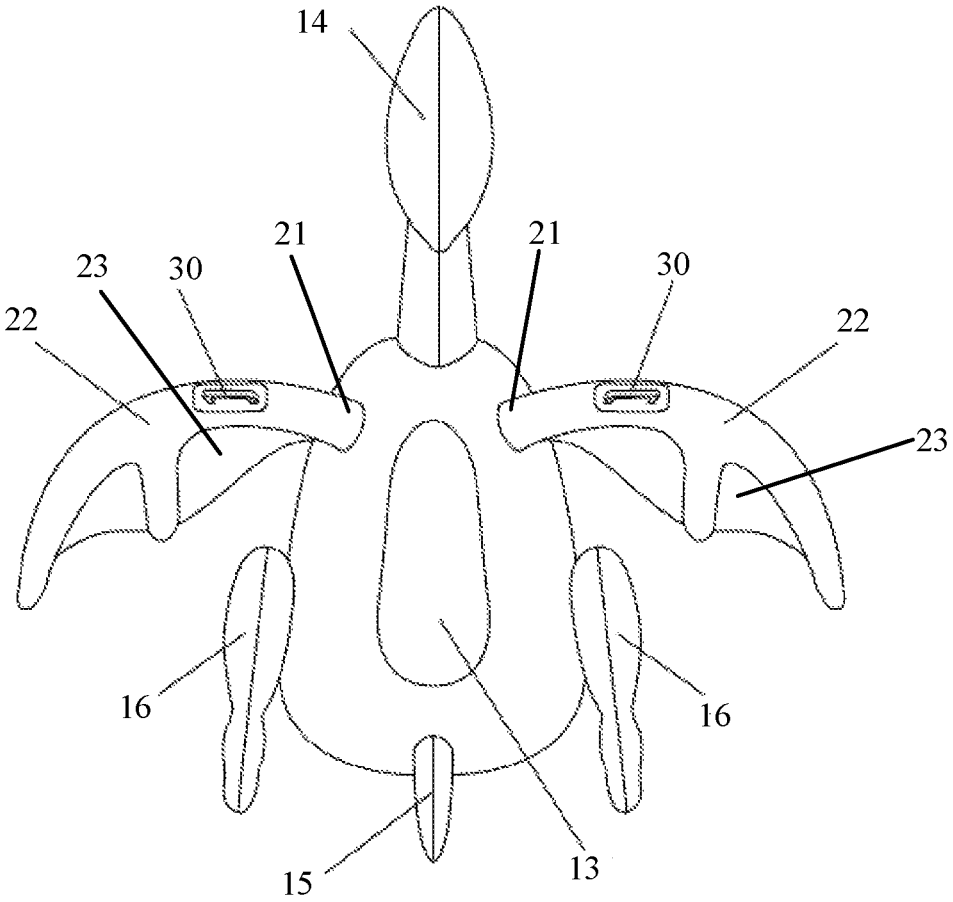
FIG. 3 is a top view of a human-powered entertainment device according to one embodiment of the present disclosure.

Referring to FIG. 1 to FIG. 3, embodiments of the present disclosure provide a human-powered entertainment device. The human-powered entertainment device includes: an inflatable base 10 and a paddling component 20.

In some embodiments, the inflatable base 10 may have an air chamber adapted to be inflated with air. Accordingly, when the air chamber of the inflatable base 10 is filled with air, the inflatable base 10 is adapted to float on water. Specifically, in some embodiments, the inflatable base 10 may include: an upper piece 11 and a lower piece 12, wherein edges of the upper piece 11 and the lower piece 12 are connected to form the air chamber.

In some embodiments, the upper piece 11 and the lower piece 12 may be made of flexible material.

In some embodiments, the upper piece 11 and the lower piece 12 may be made of thermoplastic material. In this case, the edges of the upper piece 11 and the lower piece 12 may be connected by a way of high-frequency welding, so as to form the air chamber of the inflatable base 10.

In some embodiments, a plurality of ribbons may be disposed between the upper piece 11 and the lower piece 12. The ribbons are arranged inside the air chamber formed by the upper piece 11 and the lower piece 12, wherein an upper edge of the ribbon is connected with the upper piece 11, and a lower edge of the ribbon is connected with the lower piece 12. The ribbon may be configured to be a ring-shaped structure. Further, the ribbon may be provided with vent holes.

Moreover, when the air chamber of the inflatable base 10 is filled with air, a seat portion 13 is defined, wherein a user can sit on the seat portion 13.

Accordingly, the inflatable base 10 is a main portion of the entertainment device, which is adapted to float on water and carry the user, so as to provide water recreation.

Referring to FIG. 1 to FIG. 3, the paddling component 20 may be connected to the inflatable base 10.

In some embodiments, the paddling component 20 may include: a connecting portion 21 and a paddling portion 22. Wherein, the connecting portion 21 connects the inflatable base 10 and the paddling portion 22.

In some embodiments, the connecting portion 21 is configured to be an inflatable structure. In other words, the connecting portion 21 is configured having an air chamber that can be inflated with air. A way for forming the connecting portion 21 can refer to corresponding illustrations of the inflatable base 10, which will not be described in detail herein.

In some embodiments, the connecting portion 21 and the inflatable base 10 may be connected by a way of high frequency welding. Moreover, the air chamber of the connecting portion 21 and the air chamber of the inflatable base 10 may communicate with each other. In some embodiments, the air chamber of the connecting portion 21 and the air chamber of the inflatable base 10 may not communicate.

In some embodiments, as shown in FIG. 3, the connecting portion 21 and the paddling portion 22 may be configured to be an integral structure. Specifically, the paddling portion 22 extends from the connecting portion 21, both the paddling portion 22 and the connecting portion 21 are inflatable, and the paddling portion 22 and the connecting portion 21 share a common air chamber. In other words, in this embodiment, the connecting portion 21 and the paddling portion 22 are two parts of an integral and inflatable structure.

Accordingly, when both the connecting portion 21 and the paddling portion 22 are inflatable and have a common air chamber, on one hand, the connecting portion 21 is adapted to realize elastic deformation when being subjected to an external force, so that the paddling portion 22 extending from the connecting portion 21 can swing (e.g., the paddling portion 22 may swing from a position indicated by solid lines in FIG. 2 to a position indicated by dashed lines in FIG. 2); on the other hand, the paddling portion 22 can realize swing in water to impose a force to water, so that the entertainment device can move on water under driving of a reaction force from water. Accordingly, in the entertainment device provided by the present disclosure, the paddling component 20 is arranged for realizing movement of the entertainment device. It should be noted that, in FIG. 2 the paddling portion 22 is shown swinging up and down, but the present disclosure is not limited to this. In some embodiments, the paddling portion 22 may also be capable of swinging forward and backward. In some embodiments, the paddling portion 22 may be capable of rotating, and when the paddling portion 22 is driven to rotate, a motion trail of the paddling portion 22 may be a closed loop (e.g., substantially a circle).

Further, in the entertainment device provided by embodiments of the present disclosure, all the components, such as the inflatable base 10 and the paddling component 20, can be configured to be an inflatable structure. Therefore, the entertainment device provided by embodiments of the present disclosure is low in cost, and foldable for storing and carrying.

As shown in FIG. 1 to FIG. 3, the paddling portion 22 of the paddling component 20 may be further provided with a handle 30. The handle 30 is adapted to be held, so that the user can hold the handle 30 to make the paddling portion 22 swing in the water for performing paddling.

In some embodiments, the handle 30 may be connected to the paddling portion 22 by a way such as welding. In some embodiments, the handle 30 may be connected to the connecting portion 21.

A number of the paddling component 20 may be two (e.g., the embodiment as shown in FIG. 1 to FIG. 3), and the two paddling components 20 may be arranged opposite to each other. Correspondingly, a number of the handle 30 may be two, and the two handles 30 may be disposed on surfaces of the paddling portions 22 of the two paddling components 20 facing each other, respectively. By such a way, when the user sits on the seat portion 13, he/she can hold the handle 30 to perform paddling.

In some embodiments, the handle 30 may be disposed on the connecting portion 21 of the paddling component 20.

Moreover, the number of the paddling component 20 may be one or more than two. When the number of the paddling component 20 is more than one, surfaces of the more than one paddling component 20 which are facing each other are provided with the handle 30, respectively. By such a way, the inflatable entertainment device can be operated by multiple users.

As shown in FIG. 1 to FIG. 3, the paddling portion 22 may be further provided with a flexible webbed portion 23. The flexible webbed portion 23 may be made of flexible plastic. When the air chamber of the paddling portion 22 is filled with air, the flexible webbed portion 23 will be unfolded. By such a way, when the paddling portion 22 swings to perform paddling, the flexible webbed portion 23 disposed on the paddling portion 22 will be swing along with the paddling portion 22. Therefore, a contact area between the paddling component 20 and the water is increased, and an efficiency of the paddling is enhanced.

In order to unfold the flexible webbed portion 23, a surface of the paddling portion 22 on which the flexible webbed portion 23 is disposed (e.g., the surface of the paddling portion 22 facing the inflatable base 10 as shown in FIG. 3) may be configured into a curved surface to define a space, so that the flexible webbed portion 23 can be unfolded within the space defined.

In some embodiments, the flexible webbed portion 23 and the paddling portion 22 may be integrally formed. Specifically, the paddling portion 22 is configured having an upper piece and a lower piece, wherein the lower piece has a size larger than that of the upper piece, so that when an edge of the upper piece is welded to the lower piece, one part of the lower piece with the upper piece can define the air chamber of the paddling portion 22, and the other part of lower piece extending from the paddling portion 22 can define the flexible webbed portion 23. In some embodiments, the flexible webbed portion 23 and the paddling portion 22 may be separately formed and then welded together.

Figure 4:
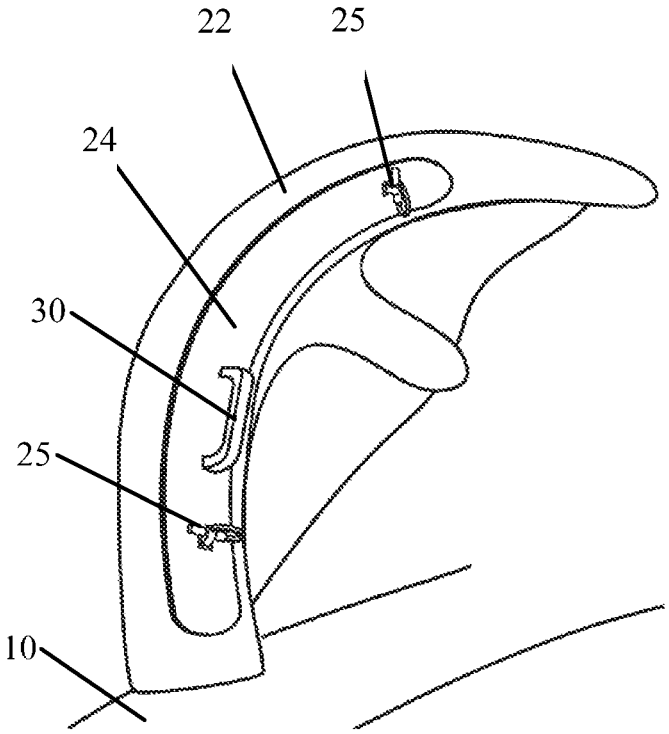
FIG. 4 is a diagram of a paddling component of a human-powered entertainment device according to another embodiment of the present disclosure.

When the paddling portion 22 of the paddling component 20 is configured to be inflatable structure, in order to enhance a rigidity of the paddling component 20, in some embodiments of the present disclosure, the paddling portion 22 may be further provided with an enhancement portion 24, as shown in FIG. 4. The enhancement portion 24 is attached to a surface of the paddling portion 22, and extends along a longitudinal direction of the paddling portion 22. The enhancement portion 24 has a rigidity larger than that of the paddling portion 22. For example, the enhancement portion 24 may be made of rigid plastic. By such a way, when the paddling portion 22 swings to perform paddling, the enhancement portion 24 can maintain the shape of the paddling portion 22, so as to further improve the efficiency of the paddling.

Figure 5:
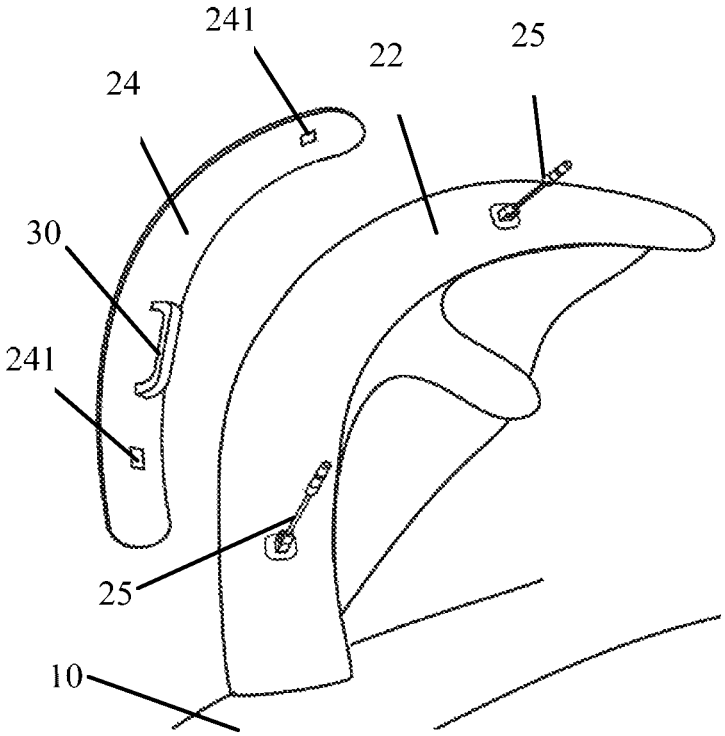
FIG. 5 is another diagram of the paddling component shown in FIG. 4.
Figure 6:
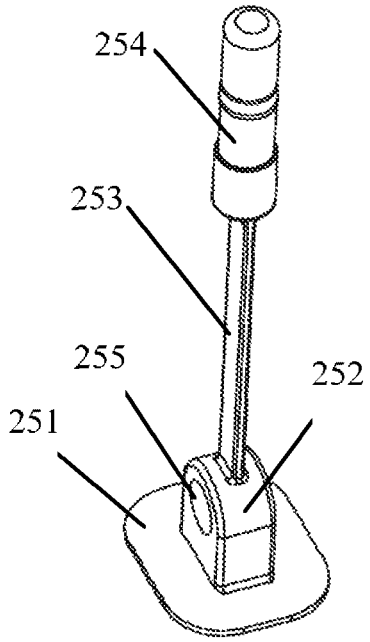
FIG. 6 is a diagram of a fixing element of the paddling component shown in FIG. 4.
Figure 7:
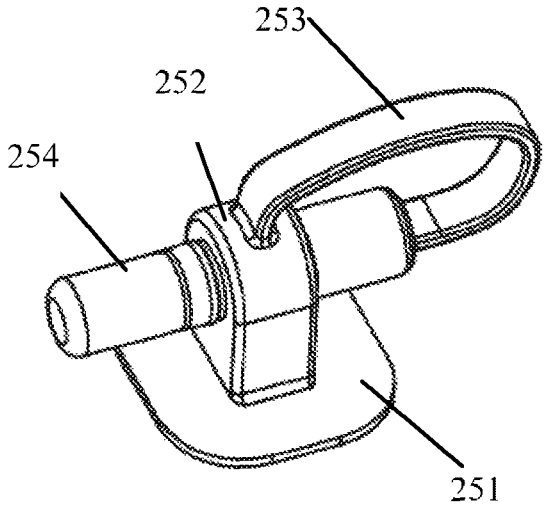
FIG. 7 is another diagram of the fixing element of the paddling component shown in FIG. 4.

As shown in FIG. 4, in some embodiments, the enhancement portion 24 may be detachably fixed to the paddling portion 22. For example, the enhancement portion 24 may be detachably fixed to the paddling portion 22 via a fixing element 25. Specifically, as shown in FIG. 5 to FIG. 7, the fixing element 25 includes: a mounting portion 251, a protruding portion 252, a flexible connecting portion 253 and a retaining portion 254 which are successively connected. The protruding portion 252 is configured with a retaining hole 255. The enhancement portion 24 is formed with a mounting hole 241. The mounting portion 251 of the fixing element 25 can be fixed to the paddling portion 22 by a way such as welding. The protruding portion 252 of the fixing element 25 can penetrate through the mounting hole 241 of the enhancement portion 24, and expose the retaining hole 255 on the protruding portion 252. The flexible connecting portion 253 can be bended towards the retaining hole 255, so that the retaining portion 254 connected to the flexible connecting portion 253 can penetrate through the retaining hole 255. By such a way, the enhancement portion 24 can be confined between the mounting portion 251 of the fixing element 25 and the retaining portion 254 of the fixing element 25. Therefore, the enhancement portion 24 can be fixed to the paddling portion 22. Further, when the retaining portion 254 of the fixing element 25 pulled out from the retaining hole 255, the enhancement portion 24 can depart from the fixing element 25, so that the enhancement portion 24 can be detached from the paddling portion 22.

The enhancement portion 24 may be detachably fixed to the paddling portion 22 via one or more fixing elements 25 (e.g., two fixing elements 25 as shown in FIG. 4). Correspondingly, the enhancement portion 24 may be disposed with one or more mounting holes 241 (e.g., two mounting holes 241 as shown in FIG. 5) which match with the one or more fixing elements 25.

In some embodiments, the handle 30 may be disposed on the enhancement portion 24, that is, the handle 30 is arranged on the paddling portion 22 of the paddling component 20 via the enhancement portion 24.

Moreover, in some embodiments, when the air chamber of the connecting portion 21 is inflated with air, the connecting portion 21 may have a cross section shaped in circle or oval. It should be noted that, when the cross section is shaped in circle or oval, it means that, an outer periphery of the cross section has a shape of circle or oval.

It also should be noted that, when the connecting portion 21 of the paddling component 20 is configured to be inflatable structure, if a dimension of the cross section of the connecting portion 21 is too large, it may be hard to rotate the connecting portion 21 to perform paddling, and if the dimension of the cross section of the connecting portion 21 is too small, the rigidity of the connecting portion 21 may be not large enough for supporting the paddling portion 22. Accordingly, both factors of a force needed for rotating the connecting portion 21 and if the rigidity of the connecting portion 21 is large enough for supporting the paddling portion 21 should be taken into consideration, in some embodiments, when the connecting portion 21 has a cross section in circle when being inflated with air, a diameter of the circle is set ranging from 5 cm to 25 cm. In some embodiments, when the connecting portion 21 has a cross section in oval when being inflated with air, a long axis of the oval is set ranging from 5 cm to 25 cm. Optionally, the diameter of the circle or the long axis of the oval ranges from 10 cm to 15 cm.

As shown in FIG. 3, in some embodiments, the inflatable base 10 may be configured with: a head portion 14, a tail portion 15 and stabilization portions 16. The head portion 14 is arranged at the front portion of the inflatable base 10. The tail portion 15 is arranged at the rear portion of the inflatable base 10. A number of the stabilization portion 16 is two. The two stabilization portions 16 are respectively arranged at two sides of the inflatable base 10. Accordingly, the entertainment device is shaped in a corresponding animal (e.g., pterodactyl as shown in FIG. 1 to FIG. 3).

It should be noted that, the entertainment device may be shaped in other animals, such as swan, flamingo, sea turtle, carpenter worm, etc. The paddling component may serve as wings and/or feet of the animal-like shape.

It also should be noted that, embodiments shown in FIG. 1 to FIG. 7 are just for exemplarily illustrating the technical solution of the present disclosure, but not for limitation.

For example, in some embodiments, the connecting portion and the paddling portion of the paddling component may be configured into two separate and independent components. Moreover, the paddling portion may be detachably fixed to the connecting portion.

For another example, in some embodiments, the connecting portion of the paddling component may include an elastic part adapted to be bended, such that the paddling portion is able to swing to perform paddling. For instance, the connecting portion may be made of elastic material (e.g., rubber, flexible plastic, etc.). It should be noted that, both factors of the force needed for rotating the connecting portion and if rigidity of the connecting portion is large enough for supporting the paddling portion should be taken into consideration when selecting the material of the connecting portion.

For another example, in some embodiments, the paddling portion may be made of rigid plastic.

For another example, in some embodiments, the paddling portion may be made of flexible plastic, and is adapted to be unfolded for paddling.

Figure 8:
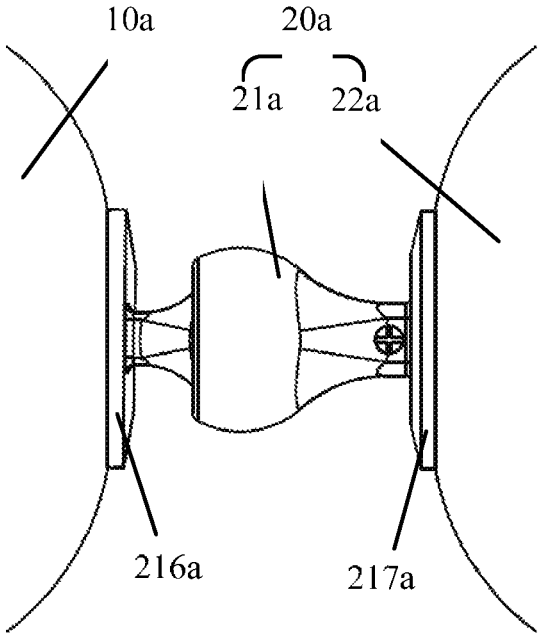
FIG. 8 partially illustrates a human-powered entertainment device according to another embodiment of the present disclosure.

Referring to FIG. 8, an embodiment of the present disclosure provides another human-power entertainment device. The human-powered entertainment device includes: an inflatable base 10*a* and a paddling component 20*a*. The inflatable base 10*a* and the paddling component 20*a* are connected.

It should be noted that, FIG. 8 only shows a part of the entertainment device, specifically, only shows a connection portion between the inflatable base 10*a* and the paddling component 20*a*. The whole structure of the inflatable base 10*a* can refer to the embodiment shown in FIG. 1 to FIG. 3, which will not be described in detail.

The paddling component 20*a* includes: a connecting portion 21*a* and a paddling portion 22*a*. FIG. 8 only shows a connection portion between the paddling portion 22*a* and the connecting portion 21*a*. Configuration of the paddling portion 22*a* can refer to corresponding descriptions in above recited embodiments, which will not be described in detail.

Different from the embodiment shown in FIG. 1 to FIG. 7, in the present embodiment, the connecting portion 21*a* is configured to be a rotary mechanism. That is to say, the connecting portion 21*a* achieves rotation not via elastic deformation itself but via being configured to be a rotary mechanism. Accordingly, through rotation of the connecting portion 21*a* (under an external force), the paddling portion 22*a* connected to the connecting portion 21*a* swings to paddling.

Figure 9:
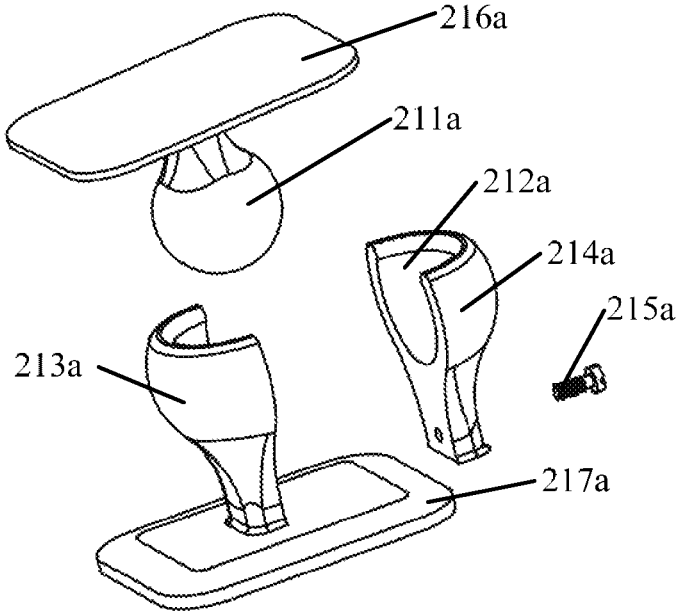
FIG. 9 is an explosive view of a connecting portion of a paddling component of the human-powered entertainment device shown in FIG. 8.
Figure 10:
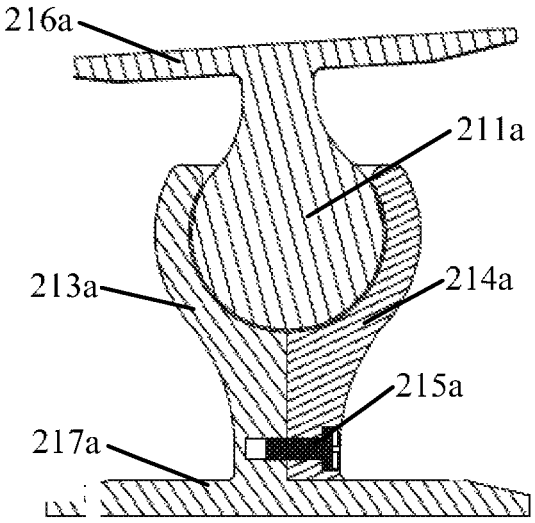
FIG. 10 is a sectional view of the connecting portion of the paddling component of the human-powered entertainment device shown in FIG. 8.

In some embodiments, referring to FIG. 9 and FIG. 10, the connecting portion 21*a* includes: a male structure part 211*a* and a female structure part 212*a*. The male structure part 211*a* is adapted to be accommodated in the female structure part 212*a*, and rotate with respect to the female structure part 212*a*. The male structure part 211*a* and the female structure part 212*a* are respectively connected to the inflatable base 10*a* and the paddling component 20*a*. By such a way, when the male structure part 211*a* and the female structure part 212*a* relatively rotate, the paddling portion 22*a* can rotate with respect to the inflatable base 10*a* to achieve paddling.

In some embodiments, as shown in FIG. 8 to FIG. 10, the male structure part 211*a* is configured to be a ball head, and the female structure part 212*a* is configured to be a ball socket. Specifically, the ball socket 212*a* (i.e., the female structure part) may be formed by two ball socket shells 213*a* and 214*a* which are fastened together. The two ball socket shells 213*a* and 214*a* may be detachably connected together via a fastening element 215*a*. The ball head 211*a* (i.e., the male structure part) can be connected to the inflatable base 10*a* via a first base plate 216*a*. The ball socket shells 213*a* and 214*a* forming the ball socket 212*a* can be connected to the paddling portion 22*a* via a second base plate 217*a*. By such a way, when fastening the ball socket shells 213*a* and 214*a* together via the fastening element 215*a*, the ball head 211*a* can be confined within the ball socket 212*a* and rotate with respect to the ball socket 212*a*, so that the paddling portion 22*a* can swing to paddling. When the fastening element is loosen, the ball socket shells 213*a* and 214*a* can be separated from each other, so that the ball head 211*a* can depart from the ball socket 212*a*, the paddling portion 22*a* can be detached from the inflatable base 10*a* for easily storing and carrying.

It should be noted that, even in the embodiment as shown in FIG. 8 to FIG. 10, the ball head 211*a* is connected to the inflatable base 10*a* via the first base plate 216*a*, and the ball socket shells 213*a* and 214*a* forming the ball socket 212*a* are connected to the paddling portion 22*a* via the second base plate 217*a*, in other embodiments, the ball head 211*a* may be connected to the paddling portion 22*a* via the first base plate 216*a*, and the ball socket shells 213*a* and 214*a* forming the ball socket 212*a* are connected to the inflatable base 10*a* via the second base plate 217*a*.

In some embodiments, the first base plate 216*a* may be connected to the inflatable base 10*a* or the paddling portion 22*a* by a way such as welding, bounding, etc. Similarly, the second base plate 217*a* may be connected to the inflatable base 10*a* or the paddling portion 22*a* by a way such as welding, bounding, etc.

It should be noted that, the male structure part may be configured into other protrusion-shaped structures except the ball head, and female structure part may be configured into other groove-shaped structures except the ball socket, as long as the male structure part and the female structure part can match with each other and relatively rotate.

In some embodiments, the connecting portion may be configured into a revolving shaft for realizing rotation.

Although the present disclosure has been disclosed above with reference to preferred embodiments thereof, it should be understood by those skilled in the art that various changes and modifications may be made without departing from the spirit or scope of the disclosure. Accordingly, the present disclosure covers changes and modifications made to the present disclosure that fall into scopes defined by the claims and equivalent technical solutions thereof.

The invention claimed is:

1. A human-powered entertainment device, comprising:

an inflatable base; and at least one paddling component, connected with the inflatable base, wherein the at least one paddling component is capable of swinging when a force is imposed thereon so as to perform paddling in water to make the human-powered entertainment device move on water;

wherein each of the at least one paddling component comprises:

an inflatable paddling portion configured to swing to perform paddling in water; and a connecting portion for connecting the paddling portion with the inflatable base, the connection portion being configured to be a rotary mechanism.

2. The entertainment device according to claim 1, wherein the at least one paddling component is provided with at least one handle.

3. The entertainment device according to claim 2, wherein a number of the at least one paddling component is more than one; and each two of the paddling components are disposed opposite to each other and provided with the at least one handle.

4. The entertainment device according to claim 1, wherein the connecting portion comprises a male structure part and a female structure part; and the male structure part is rotatably accommodated in the female structure part.

5. The entertainment device according to claim 1, wherein the connecting portion comprises an elastic part adapted to be bended, such that the paddling portion is capable of swinging.

6. The entertainment device according to claim 1, wherein the paddling portion is provided with an enhancement portion attached to a surface of the paddling portion, and the enhancement portion is configured to maintain a shape of the paddling portion when the paddling portion performs paddling the paddling.

7. The entertainment device according to claim 1, wherein the paddling portion comprises a webbed portion; and the webbed portion is made of flexible plastic and configured to be unfolded for performing paddling.

8. The entertainment device according to claim 1, wherein the paddling portion is detachably connected with the connecting portion.

9. The entertainment device according to claim 1, wherein the paddling portion is integrally connected with the connecting portion.

10. A human-powered entertainment device, comprising:

an inflatable base; and at least one paddling component, connected with the inflatable base, wherein the at least one paddling component is capable of swinging when a force is imposed thereon so as to perform paddling in water to make the human-powered entertainment device move on water; and wherein each of the at least one paddling component comprises:

a paddling portion configured to swing to perform paddling in water; and a connecting portion for connecting the paddling portion with the inflatable base, the connecting portion configured to be a rotary mechanism;

wherein the paddling portion is integrally connected with the connecting portion, and both the connecting portion and the paddling portion are inflatable.

11. The entertainment device according to claim 10, wherein at least one of the connecting portion and the paddling portion is provided with at least one handle.

12. The entertainment device according to claim 10, wherein the paddling portion is provided with a flexible webbed portion; and the flexible webbed portion is configured to be unfolded when the air chamber is inflated with air.

13. The entertainment device according to claim 10, wherein the paddling portion is provided with an enhancement portion attached to a surface of the paddling portion; and the enhancement portion is configured to maintain a shape of the paddling portion when the paddling portion performs paddling.

14. The entertainment device according to claim 13, wherein the enhancement portion is detachably connected with the paddling portion.

15. The entertainment device according to claim 10, wherein when the connecting portion is inflated, a cross section of the connecting portion is shaped in circle or oval.

16. The entertainment device according to claim 15, wherein when the connecting portion is inflated, the cross section of the connecting portion is shaped in circle with a diameter ranging from 5 cm to 25 cm.

17. The entertainment device according to claim 15, wherein when the connecting portion is inflated, the cross section of the connecting portion is shaped in oval with a long axis ranging from 5 cm to 25 cm.

* * * * *